US009199243B2

(12) United States Patent
Malkamäki

(10) Patent No.: US 9,199,243 B2
(45) Date of Patent: Dec. 1, 2015

(54) METHOD AND APPARATUS FOR CRUSHING MINERAL MATERIAL

(75) Inventor: Jorma Malkamäki, Tervajoki (FI)

(73) Assignee: ECOMECA OY, Tervajoki (FI)

( * ) Notice: Subject to any disclaimer, the term of this patent is extended or adjusted under 35 U.S.C. 154(b) by 245 days.

(21) Appl. No.: 13/818,555

(22) PCT Filed: Jul. 14, 2011

(86) PCT No.: PCT/FI2011/050654

§ 371 (c)(1),
(2), (4) Date: Feb. 22, 2013

(87) PCT Pub. No.: WO2012/028766

PCT Pub. Date: Mar. 8, 2012

(65) Prior Publication Data

US 2013/0146691 A1 Jun. 13, 2013

(30) Foreign Application Priority Data

Aug. 30, 2010 (FI) ..... 20105899

(51) Int. Cl.
*B02C 18/06* (2006.01)
*B02C 23/08* (2006.01)
(Continued)

(52) U.S. Cl.
CPC ..... *B02C 23/08* (2013.01); *B02C 18/144* (2013.01); *B02C 18/146* (2013.01); *B07B 1/20* (2013.01);
(Continued)

(58) Field of Classification Search
CPC ..... E02F 3/96; E02F 3/40; B02C 4/08; B02C 4/12; B02C 13/09; B02C 23/08
USPC ..... 241/81, 101.72, 101.73
See application file for complete search history.

(56) References Cited

U.S. PATENT DOCUMENTS 5,154,363 A 10/1992 Eddy
5,419,380 A 5/1995 Bot
(Continued)

FOREIGN PATENT DOCUMENTS

AU B-48166 3/1996
CA 2247715 3/2000
(Continued)

OTHER PUBLICATIONS

WIPO, Finnish Patent Office as ISA, PCT/FI2011/050654, International Search Report mailed Nov. 4, 2011.
(Continued)

*Primary Examiner* — Mark Rosenbaum
(74) *Attorney, Agent, or Firm* — Otterstedt, Ellenbogen & Kammer, LLP

(57) ABSTRACT

The present invention relates to a method and apparatus for crushing a mineral material. Then, the mineral material is delivered in a crushing space (6) towards crushing means (8), whereby at least a portion of the material flow is discharged via a screen (20). The remaining mineral material is arranged to meet transfer and screening as well as crusher drums (10, 11) provided in the crushing space such that the transfer and screening drum continues pre-screening while simultaneously transferring the mineral material towards the crusher drum (11). Finally, the mineral material remaining in the crushing space is by crusher blades (19) of the crusher drum (11) subjected to mechanical machining wedging the mineral material against a crusher plate (21) and decreasing the particle size thereof in order for the mineral material to be finally crushed into a particle size to be discharged from the crushing space.

16 Claims, 4 Drawing Sheets

(51) Int. Cl.

| | |
|---|---|
| ***B02C 18/14*** | (2006.01) |
| ***B07B 1/20*** | (2006.01) |
| ***E02F 3/407*** | (2006.01) |
| ***E02F 7/06*** | (2006.01) |
| *B02C 18/22* | (2006.01) |
| *B02C 23/02* | (2006.01) |

(52) U.S. Cl.

CPC . *E02F 3/407* (2013.01); *E02F 7/06* (2013.01); *B02C 18/06* (2013.01); *B02C 18/22* (2013.01); *B02C 23/02* (2013.01)

(56) References Cited

U.S. PATENT DOCUMENTS

| | | | |
|---|---|---|---|
| 5,474,239 | A | 12/1995 | Williams, Jr. |
| 5,485,689 | A | 1/1996 | Jonninen |
| 5,887,810 | A | 3/1999 | Maruyama |
| 7,284,720 | B2 | 10/2007 | Ramun |
| 2003/0075628 | A1 | 4/2003 | Pretzler et al. |
| 2004/0050984 | A1 | 3/2004 | Rossi, Jr. |
| 2007/0029422 | A1 | 2/2007 | Niemela et al. |

FOREIGN PATENT DOCUMENTS

| | | |
|---|---|---|
| CN | 201223806 | 4/2009 |
| DE | 4039934 | 6/1992 |
| DE | 20205892 | 8/2002 |
| EP | 1001093 | 5/2000 |
| EP | 1189701 | 3/2002 |
| EP | 1643039 | 4/2006 |
| FI | 91718 | 4/1994 |
| FI | 106931 | 5/2001 |
| GB | 863249 | 3/1961 |
| GB | 991757 | 5/1965 |
| GB | 2152840 | 8/1985 |
| GB | 2182862 | 5/1987 |
| GB | 2185423 | 7/1987 |
| GB | 2278071 | 11/1994 |
| GB | 2401096 | 11/2004 |
| GB | 2440261 | 1/2008 |
| GB | 2449953 | 12/2008 |
| JP | U57919 | 1/1982 |
| JP | U5986250 | 6/1984 |
| JP | U60100043 | 7/1985 |
| JP | 9187670 | 7/1997 |
| JP | 10037227 | 2/1998 |
| JP | 10168927 | 6/1998 |
| JP | 2000008403 | 1/2000 |
| JP | 2001054742 | 2/2001 |
| JP | 2001073563 | 3/2001 |
| JP | 2001087710 | 4/2001 |
| JP | 2001293385 | 10/2001 |
| JP | 2003278180 | 10/2003 |
| JP | 2005220513 | 8/2005 |
| WO | WO 2004026478 | 1/2004 |
| WO | WO 2006105864 | 10/2006 |

OTHER PUBLICATIONS

WIPO, Finnish Patent Office as ISA, PCT/FI2011/050654, International Preliminary Report on Patentability mailed Oct. 12, 2012.

WIPO, Finnish Patent Office as ISA, PCT/FI2011/050654, Written Opinion mailed Nov. 4, 2011.

Finnish Patent Office, Search Report for Finnish Patent Application 20105899 mailed Apr. 28, 2011.

Finnish Patent Office, First Office Action for Finnish Patent Application 20105899 mailed Apr. 28, 2011.

Finnish Patent Office, Second Office Action for Finnish Patent Application 20105899 mailed Nov. 3, 2011.

Japanese Patent Office, Japanese Patent Appln. No. 2013-526519, English Translation of Office Action Mailed Apr. 16, 2015, pp. 1-7.

METHOD AND APPARATUS FOR CRUSHING MINERAL MATERIAL

The present application is a national stage entry, under 35 USC 371, of PCT International Patent Application Number PCT/FI2011/050654 filed on 14 Jul. 2011, which claims priority to Finnish Patent Application Number 20105899 filed on 30 Aug. 2010. The complete disclosures of the aforesaid International Patent Application Number PCT/FI2011/050654 and Finnish Patent Application Number 20105899 are expressly incorporated herein by reference in their entireties for all purposes.

BACKGROUND OF THE INVENTION

The present invention relates to a method for crushing mineral and organic materials; for example, a method of crushing a mineral material, whereby the mineral material is delivered to a crushing space of a bucket, in which space the mineral material is by crusher blades subjected to impacts decreasing its particle size, and mineral particles having a size meeting a predetermined cross-sectional measure are delivered to be discharged from the crushing space. Particularly, the present method is implementable by utilizing a mobile working machine.

The present invention also relates to an apparatus for crushing a mineral material for implementing said method of crushing mineral and organic materials.

It is, of course, previously known to carry out crushing by special devices called bucket crushers used in mobile working machines. Such devices include e.g. jaw crushers wherein normally in a working position an upper jaw is adapted to be mobile by means of either a hydraulic cylinder or a hydraulic motor. The mobile jaw of such a jaw crusher crushes the material loaded thereto against a stationary jaw. The material mainly consists of construction waste. In the jaw crusher, the entire material flow delivered thereto has to pass through the crusher in order to be discharged via an opening provided at a lower end of the pair of jaws. At the same time, the height of the opening at the lower end of the pair of jaws dictates the final maximum particle size of the crushed material being discharged from the jaw crusher, in which case the height of the opening is usually adapted to be adjustable in one way or another. Such a product is manufactured e.g. by a British company called Dig A Crusher Limited.

However, a problem with such a jaw crusher is a hopper provided by the jaw crusher's mobile jaw and stationary jaw therebetween. Being compelled to pass through this hopper, all material delivered to the jaw crusher will, of course, be gradually crushed into a desired particle size. Irrespective of the moving mechanism of the mobile jaw, in any case the jaw will only crush particles of material that happen to be appropriately located with respect to the pair of jaws. It is also typical of this device that larger particles of material to be crushed prevent smaller particles in the material flow from passing through. In addition, the structure of the mobile jaw of the jaw crusher has to be very robust, which means it is also quite heavy. Thus, owing to its large mass, the mobile jaw of the jaw crusher, when moving, causes a great inertial force which to a disadvantageous extent makes a boom of the excavator carrying the mobile jaw vibrate, thus shortening the service life of the boom. Owing to the large mass, the motion velocity of the jaw is also limited, thus requiring a good efficiency of the hydraulic arrangement controlling it. Also, since the jaw is capable of performing only one crush during each to-and-fro motion, the crushing capacity of the jaw crusher remains rather low. Also, the aforementioned phenomenon of small material particles being prevented from passing through adds to decreasing the crushing power of such a device.

On the other hand, devices called screen crushers are known wherein the material is mainly screened but wherein crushing of earth clods or corresponding relatively soft or fragile pieces is also carried out by means of several rotating drums. In such screen crushers, blades are usually welded in between discs provided in a drum, in which case the blades move the material delivered to the device from between the discs to a screen heap. Such devices are manufactured e.g. by a Finnish company called ALLU Finland Oy. Such devices are also described e.g. in patent specification JP 2001293385 or utility model specification DE 202 05 892.

In such devices, the material becomes crushed only if it is sufficiently fragile or soft. These devices are based on so-called gravitational feed, i.e. the material is crushed only if a stroke of a blade suffices to break the material. On the other hand, a problem arising with such a screen crusher is also the excess density of the material delivered to the bucket, in which case the material tends to get hung up inside the bucket. This is because the drums, including their blades, of the device only work their own space in to the material, whereby the rest of the material inside the bucket is no longer allowed to flow down to the drums. In order to prevent the material from becoming hung up, the bucket of the screen crusher is usually made quite shallow. This makes it possible to ensure that the material flow to the drums is better and more uniform. However, the structure of the known screen crushers is not designed for crushing hard mineral pieces but all material that after a screening cycle is larger than an interspace between discs is emptied in to a separate waste heap. Consequently, the device causes considerable noise disturbing the environment when a material abundant in rocks is screened. The screen crusher is incapable of crushing rocks but they remain inside the bucket, bouncing around. When the structure of the device is low, the noise caused by the screen crusher spreads out to the environment of the device with no difficulty.

BRIEF DESCRIPTION OF THE INVENTION

It is thus an object of the invention to provide a method and an apparatus implementing the method so as to enable the aforementioned problems to be solved. This object is achieved such that the method and apparatus for crushing a mineral material are according to the present invention provided with the characteristic features defined in the claims.

Particularly, the above-disclosed problems may be solved by a method achieved by combining the characteristic features in a manner disclosed in the characterizing part of claim 1. On the other hand, such a method may be implemented by an apparatus achieved by combining the characteristic features in a manner disclosed in the characterizing part of claim 6.

Preferred embodiments of the invention are disclosed in the dependent claims.

The invention is based on the idea that it is possible to quickly separate the rather a large amount of fine material often contained in the material to be crushed so as to prevent it from constituting a disadvantageous impediment to the actual crushing work.

The invention provides considerable advantages. Thus, the fine material contained in the construction waste to be crushed is directed both freely via a screen and partly forced by the blades of the drums provided in the apparatus to fall from between the apparatus and the discs in the drums out of the crushing space of the apparatus. This enables the crushing power of the apparatus to be enhanced significantly since this fine material no longer obstructs the actual crushing. At the same time, the apparatus both strikes on and mills the material into a desired particle size already while conveying it to a crusher drum, thus enhancing and speeding up the processing of the material in the apparatus.

By providing the apparatus according to the invention with pre-screening of fine material, the problems caused by the fine material for crushing may be minimized. This solution enables the bucket to be made clearly deeper than previously, in which case the harmful effects of noise caused by crushing may be minimized. In practice, the noise caused by the apparatus according to the invention is in fact less than 80 dB at a distance of 15 m from the apparatus.

Preferably, the present apparatus may be provided with only one actual crusher drum whose blades crush large particles contained in the material against a crusher plate of the apparatus. Preferably, the crusher plate is provided with carbide-coated wear pieces designed to be highly resistant to wear. The distance between the crusher plate and the crusher drum dictates the particle size of the resulting crushed material. Hence, the particle size may be easily adjusted by changing the position of the crusher plate.

The one or more drums provided in the apparatus comprise discs which project therefrom and which are provided with crusher blades. These crusher blades cause a point load on the material to be crushed, making the material easy to crush.

When the apparatus is provided with several drums, other drums serve as conveyors of large particles contained in the material and, simultaneously, also as screens for a fine fraction. The number of crusher blades of the drums varies according to the effective width of the bucket. When the effective width is in the order of 70 to 130 cm, the number of crusher blades preferably varies between ten and twenty, such that the crusher blades are evenly spaced apart along the circumference of the drum. During one cycle of the crusher drum, the crusher blades deliver 2 to 4 crushing strokes on the material to be crushed. Since the crusher blades reside equally spaced and also such that only one crusher blade at a time strikes on the material, the entire crushing force can always be directed to one crusher blade only. Consequently, the material becomes crushed efficiently.

The rotation speed of the drums in the apparatus is also clearly higher than the motion velocity of a jaw in a jaw crusher. This significantly increases the power of the apparatus according to the invention over the jaw crusher. In the tests conducted, in fact, a crushing capacity more than double that of these competing solutions was achieved.

By balancing the drums of the apparatus statically they are prevented from causing vibration in the actual apparatus or in the boom of the excavator, which means that the boom and the apparatus have a longer service life.

The crushing power of the present apparatus may also be significantly increased by flywheels arranged in the crusher drum, whose motion energy may in an extreme situation even triple the temporary crushing power of the apparatus and enable even hard materials to be crushed. Experimental tests have also shown that an average power demand of the apparatus according to the invention is about one third of the maximum power of the jaw crusher.

Other advantages provided by the invention are to be presented below in connection with a more detailed description of special embodiments of the invention.

BRIEF DESCRIPTION OF THE FIGURES

In the following, some preferred embodiments of the invention are explained in closer detail in reference to the accompanying drawing, in which.

DETAILED DESCRIPTION OF PREFERRED EMBODIMENTS

Figure 1:
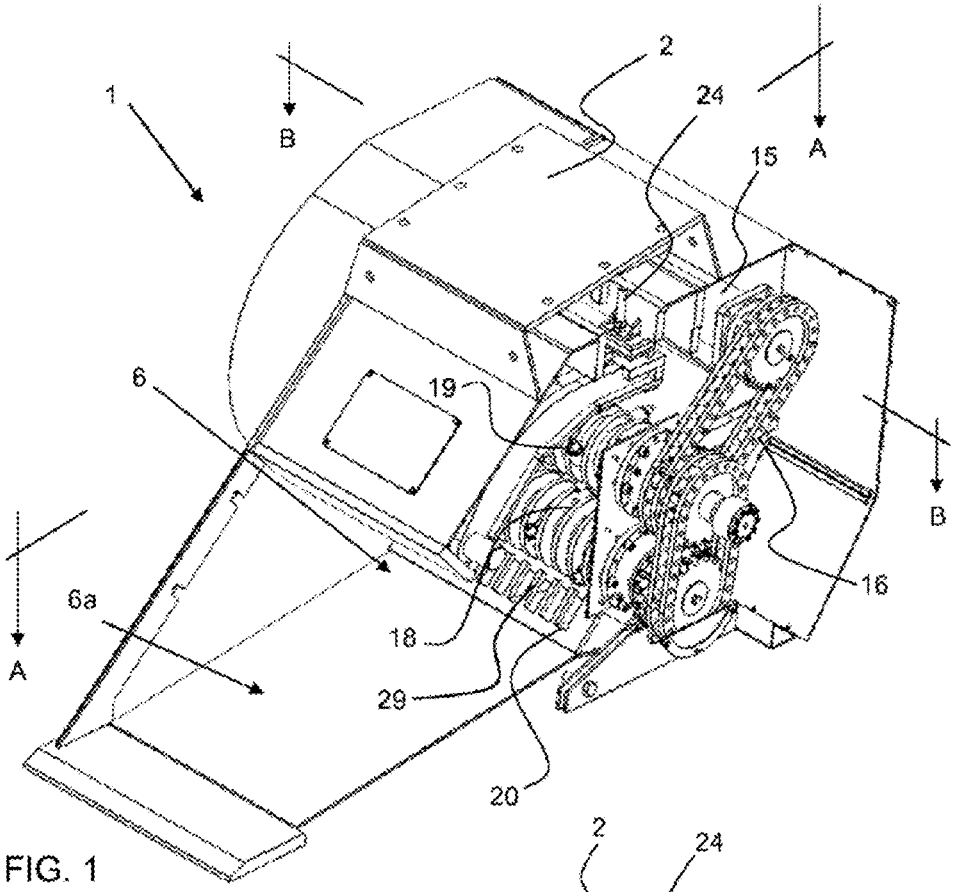
FIG. 1 is a schematic axonometric and partly sectioned view showing a first preferred embodiment of the present apparatus as seen obliquely from the front.

The present figures do not show the method and apparatus for crushing a mineral material in scale but the figures are schematic, illustrating the structure and operation of the present preferred embodiments in principle. Structural parts indicated by reference numerals in the accompanying figures then correspond to structural parts provided with reference numerals in this specification.

Figure 2:
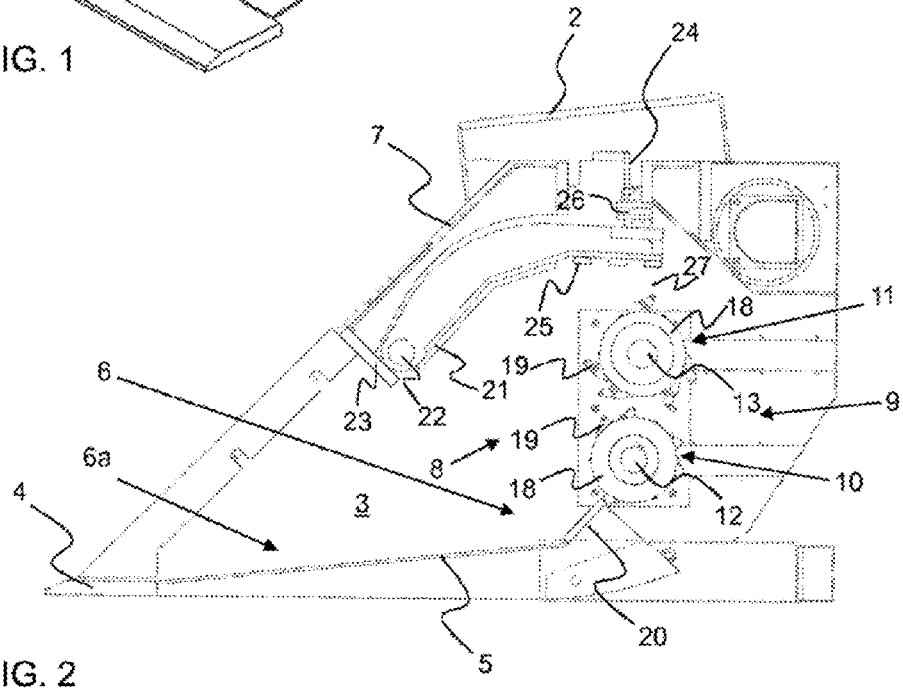
FIG. 2 is a sectional elevation of the apparatus according to FIG. 1 taken along line A-A.
Figure 3:
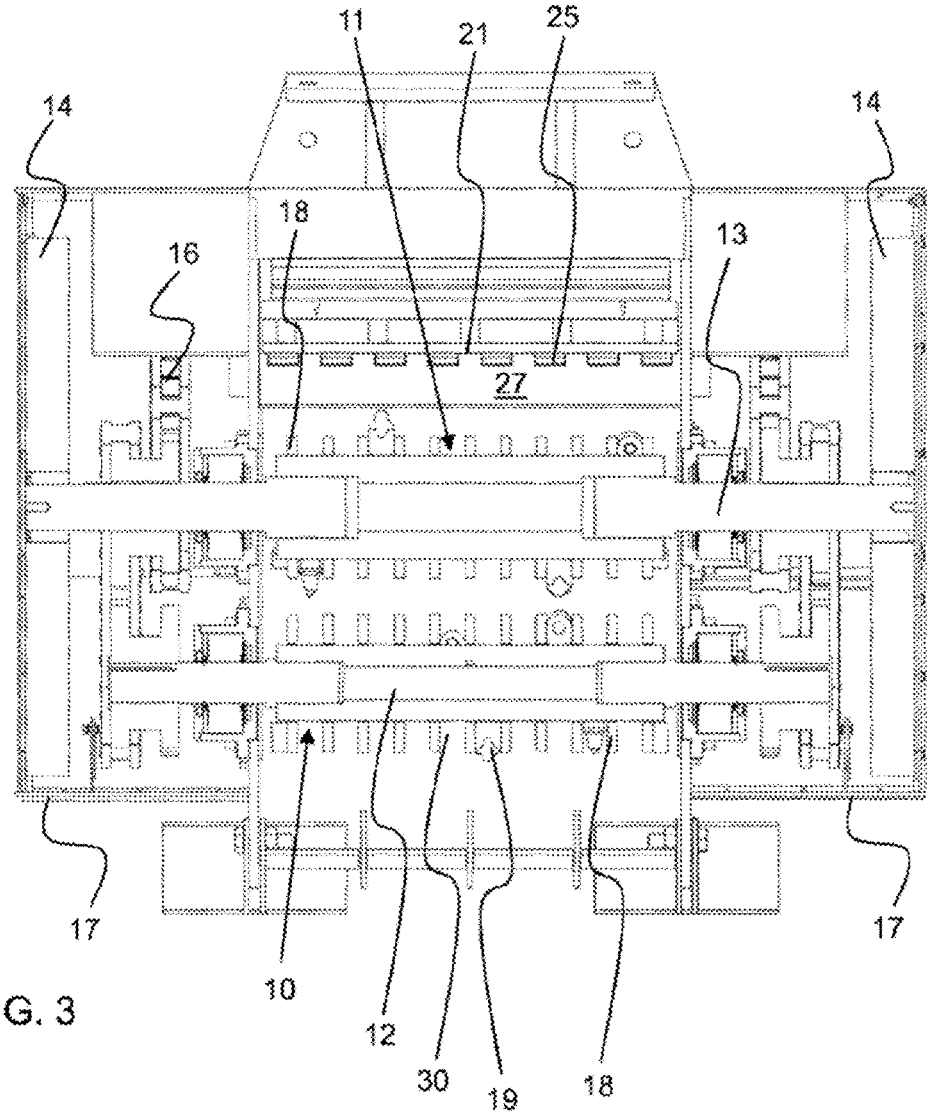
FIG. 3 is a sectional elevation of the apparatus according to FIG. 1 taken along line B-B.
Figure 4:
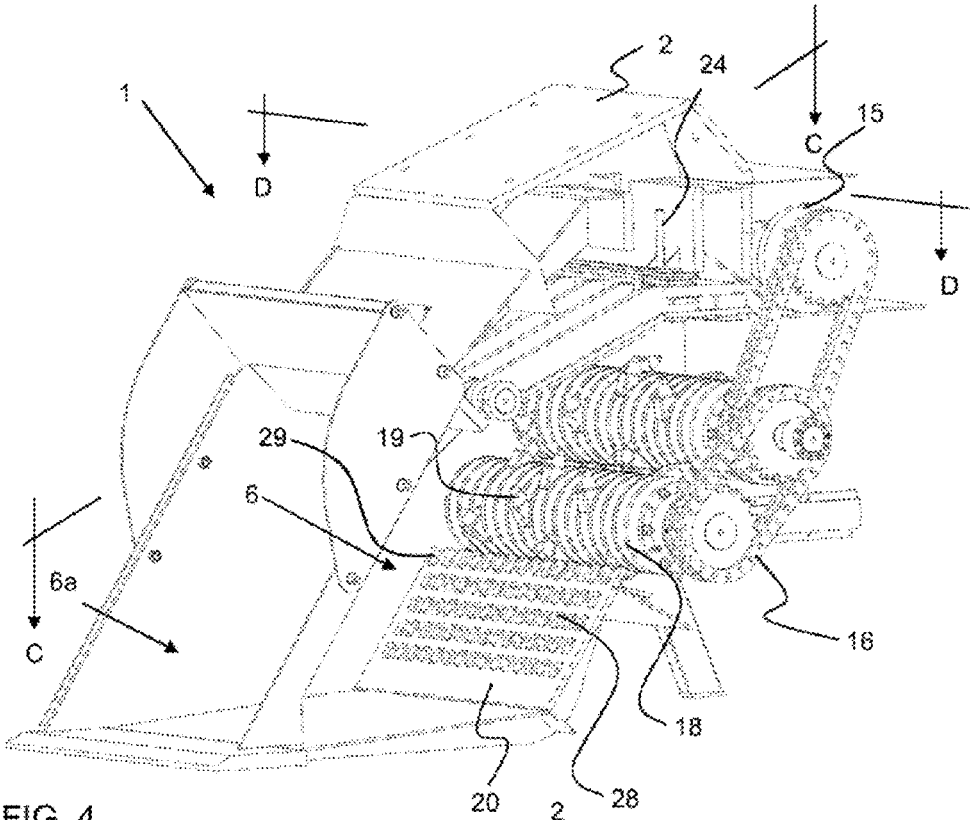
FIG. 4 is a schematic axonometric and partly sectioned view showing a second preferred embodiment of the present apparatus as seen obliquely from the front.
Figure 5:
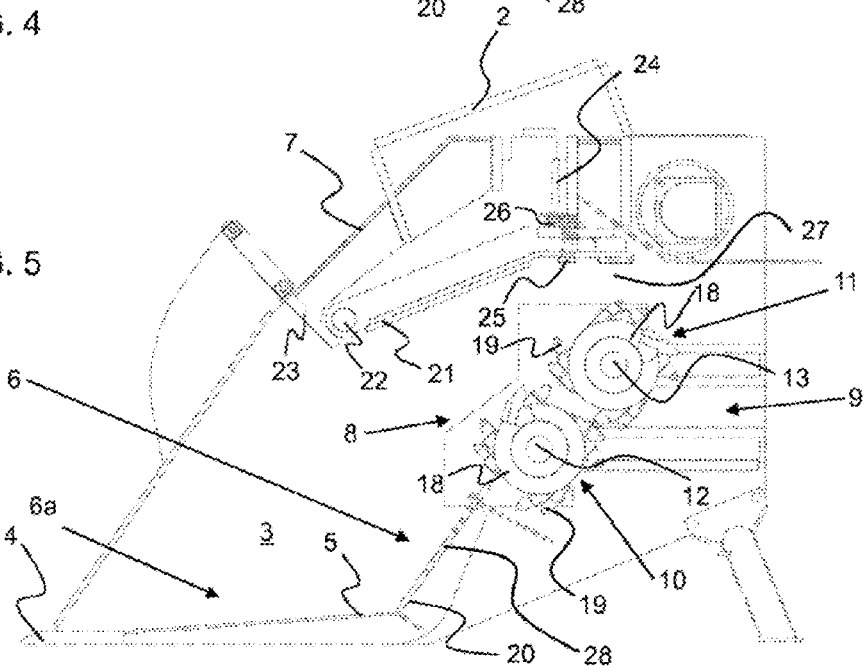
FIG. 5 is a sectional elevation of the apparatus according to FIG. 4 taken along line C-C.
Figure 6:
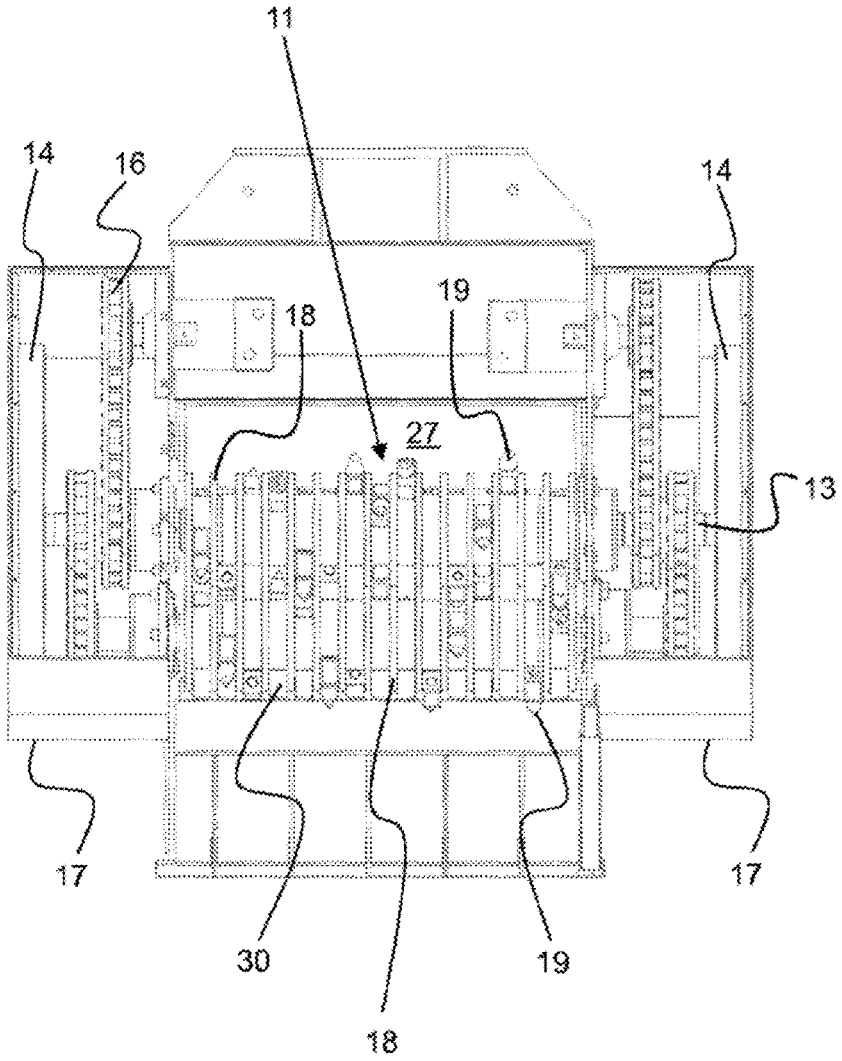
FIG. 6 is a sectional elevation of the apparatus according to FIG. 4 taken along line D-D.

Referring to FIGS. 1, 2, and 3 and, correspondingly, to FIGS. 4, 5, and 6, the present apparatus for implementing the method of crushing a mineral material may be said to comprise at least the following structural parts. For the sake of simplicity, in two embodiments of the apparatus like reference numerals identify like elements.

The first element discernible herein is a bucket 1, which constitutes a supporting frame for the apparatus, and a joint arrangement 2 therein by means of which the bucket is connected to a working machine known per se, e.g. an excavator (not separately shown herein). In a manner known per se, the bucket includes side plates 3, a lip plate 4 interconnecting the side plates, and a bottom plate 5 extending therefrom towards a rear part of the bucket. Also, an area called a crushing space 6 formed in the bucket is defined by a cover plate 7 opposite to the bottom plate and by crushing means 8 which extend substantially across the entire crushing space and which separate the crushing space from a discharge opening 9. When, preferably, the crushing space 6 is formed in the surroundings of the crushing means, a space between the crushing space and a mouth of the bucket is hereinafter called a storage space 6*a*.

In the present embodiments, the crushing means 8, in turn, include at least one transfer and screening drum 10 and one crusher drum 11. The apparatus may freely be provided with no transfer and screening drums or with even several transfer and screening drums. For instance, by using two transfer and screening drums the pre-screening of the material delivered to the bucket may be enhanced. In the present embodiments, the drums are arranged on parallel axles 12 and 13 such that they rotate in the same direction. Preferably, the axle 13 of the crusher drum 11 is provided with two flywheels 14 at opposite ends of the axle, whose motion energy may be utilized for enhancing the crushing. For example, in a prototype made of the present apparatus, the total mass of these flywheels is about 700 kg. Fastening the flywheels to the axle of the crusher drum by a friction joint simultaneously enables a simple and working overload protection to be achieved in order to avoid excess power stresses being directed to the axle.

The transfer and screening as well as crusher drums 10 and 11 derive their actual motional power e.g. according to the present invention from two hydraulic motors 15 that are also provided on the opposite sides of the bucket. According to FIGS. 3 and 6, in this embodiment, power transmission from the hydraulic motor to the axles 12 and 13 is implemented by a chain transmission 16 while overloading of the drums is prevented in a manner known per se e.g. by a pressure relief valve (not further explained herein). In these embodiments, power transmission is shown to be implemented as direct transmission. Nothing, however, prevents the transmission ratio of the power transmission from being changed e.g. by utilizing a gear reducer or by changing the number of teeth of chain wheels if great peripherical forces are considered to be necessary in the crushing. Naturally, the power transmission is also implementable by utilizing other established arrangements in the field. Preferably, in the apparatus in order to protect the power transmission it is situated outside the frame, inside cover structures 17 connected to outer surfaces of the opposite side plates 3.

The bearing system of the power transmission is protected by a nilos ring and grease. Preferably, the grease is pumped through a bearing via a cavity in a bearing cup, outside the nilos ring and into a pocket in the bearing cup and, therefrom, from between the axle and the frame of the bearing cup into the crushing space 6. In connection with greasing, dust and dirt possibly gotten in the pocket is thus also removed. In a prototype made of the present apparatus, a grease nipple and the cavity in the bearing cup are placed on opposite sides of the bearing cup.

In the crushing means 8, the minerals as well as any other material received by the crushing space, such as organic or metallic materials, are crushed particularly by crusher blades 19 that are fastened to the crusher drum 11 and discs 18 protruding from its axle 13 or in between parallel discs substantially rigidly, e.g. by welding, and that are provided with replaceable hard metal tips. Preferably, such crusher blades are also provided in a similar manner in the transfer and screening drums 10 where they not only assist in moving the material to the crusher drum but also pre-crush and screen the material. Owing to the influence of the transfer and screening drums, the particle size of the material being screened varies not only owing to the mutual position of the transfer and screening drums and the crusher drums but also owing to the mutual distance between the discs protruding from the drums. For instance, in a prototype made of the present apparatus, particles whose diameter is less than 45 mm become screened from between the transfer and screening drum and the crusher drum.

Usually, between the discs 18 that are equally spaced and protrude in parallel from the drum, only one crusher blade 19 is provided in each disc interspace. Further, the crusher blades are arranged in the disc interspaces by utilizing phase shift so as to ensure that only one crusher blade at a time impacts on the particle to be crushed in order to maximize the efficiency of a stroke.

For example, in a prototype made of the present apparatus wherein a width of the crushing space is about 70 cm, the phase shift of adjacent crusher blades 19 is set to be 108 degrees. However, such a phase shift depends on the total width of the crushing space 6. The drums 10 and 11 of this exemplary bucket 1 having a width of 70 cm are provided with ten crusher blades. By dividing the 360 degrees of the circular perimeter by the number of these crusher blades, a distribution of 36 degrees is given, by which phase shift the crusher blades would in theory be arrangeable spirally onto each drum. In order to ensure that in theory the entire crushing power of the apparatus will be directed only to one crusher blade at a time, the theoretical degree obtained above is multiplied by a multiplier of 3, the final result thus being 108 degrees. By selecting the magnitude of the multiplier to be a number by which the above-obtained theoretical distribution, i.e. in this case 36 degrees, is also divisible, it is ensured that the static balance of the drum remains. Accordingly, instead of 36 degrees, by mounting the adjacent crushing blades in to a phase shift of 108 degrees, it is consequently ensured that the particle to be crushed has enough time to be directed on to the discs 18 of the crusher drum 11 so as to enable the adjacent crusher blade 19 to strike on the particle.

When examining the transfer and screening as well as crusher drum of a bucket 1 having a width of 100 cm, the total number of crusher blades 19 is fifteen. When, in view of the above, the circular perimeter, i.e. 360 degrees, is divided by 15, the result obtained is 24 degrees. By multiplying this by a multiplier of 4 (in theory, a multiplier of 2 would also be possible), the result is 96 degrees. In other words, adjacent blades may be mounted by applying a 96 degree phase shift in order to achieve the best crushing result and operation.

When a bucket 1 has a width of 130 cm, each of the transfer and screening as well as crusher drums is provided with twenty crusher blades 19, whereby 360/20=18. Herein, it is preferable to employ the phase shift of 6×18=108 degrees of the adjacent crusher blades, i.e. the same as in the bucket 1 having the width of 70 cm. This is implemented such that the cycle of the crusher blades starts at one end with a distribution of 108 and, in midway, the phase shift is 108−18=90 degrees while the phase shift of 108 is subsequently applied to the rest. Of course, the crusher blades may be placed in various alternative ways, but these are not examined separately herein.

By the above-described placement of the crusher blades 19, it may be ensured that only one crusher blade at a time impacts on the mineral particle or a corresponding particle to be crushed and, during the same cycle of the crusher drum 11, two to four crusher blades, depending on the size of the mineral particle. The described placement also ensures that the drums are statically balanced.

The crushing means 8 further comprise a screen 20 provided between the bottom plate 5 and a first transfer and screening drum 10 or, in the absence thereof, a crusher drum 11, the screen 20 enabling a material having a predetermined size to be discharged from the crushing space. On the other hand, a crusher plate 21 which extends towards the crusher drum is provided between the crusher drum and the cover plate 7. Preferably, this crusher plate is hinged to the frame of the bucket 1, e.g. to the cover plate, from a material feed direction and in a position transverse with respect to this feed direction. Preferably, a hinging point 22 of the crusher plate is protected e.g. by a protective wall 23 according to FIG. 2 so as to prevent the joint from being damaged by impacts of mineral particles being delivered to the bucket. The crusher plate is locked to the frame of the bucket such that it is substantially immobile, preferably to the cover plate thereof or to a structure associated therewith, by means of mechanical fasteners. In the embodiment according to the figures, the joint is implemented by a bolt-nut joint 24. Such a rotating joint of the crusher plate to the frame structure of the bucket enables the distance between the crusher plate and the crusher drum to be adjusted in a simple manner. The crusher plate may be provided e.g. with carbide-coated wear pieces 25 designed to be highly resistant to wear. In addition, the crusher plate may in its entirety consist of such a coated plate or another material highly resistant to wear.

In the present embodiment, the distance adjustment is implemented by raising parts 26 arranged between the crusher plate 21 and the cover plate 7 and installed in connection with the bolt joint 24 connecting the crusher plate to the cover plate. Nothing, however, prevents the distance adjustment to be made in a bellows-operated manner, in which case the adjustment could be controllable even by remote control. In its present embodiment, the apparatus is suitable for crushing the material into a particle size which is 50 mm at its minimum and 150 mm at its maximum.

The crusher blades 19 and the crusher plates 21 of the crusher drum 11 cooperate such that the crusher blade wedges a material particle against the crusher plate, crushing it owing to the influence of subsequent impacts, such that the particle size is dictated by the distance between the crusher plate and the crusher drum, i.e. by a throat 27 thus being formed.

When comparing with one another the two present embodiments of the apparatus shown in FIGS. 1 to 3 and 4 to 6, first, it can be seen that the storage space 6 of the apparatus according to FIGS. 3 to 6 is clearly larger than the corresponding storage space 6 of the apparatus shown in FIGS. 1 to 3. This has been achieved not only by enlarging the size of the side plates 3 but also by enlarging the screen 20. This larger surface area may also be utilized by providing the screen with perforation 28 for enhancing the pre-screening carried out by the screen. Further, a comb-like element 29 provided in the screen has been extended closer to a transfer and screening or crusher drum 10 and 11 residing most adjacent thereto.

In the embodiment according to FIGS. 1 to 3, the transfer and screening drums 10 and the crusher drum 11 are arranged substantially perpendicularly with respect to the bottom plate 5 of the bucket, in which case the material in the storage and crushing spaces 6*a* and 6 of the bucket 1 can be subjected to the crushing effect of several drums for a longer period of time. When comparing this solution with the embodiment according to FIGS. 4 to 6, it can be seen that in this latter apparatus the transfer and screening drums 10 and the crusher drum are arranged on a plane which forms an angle of substantially 45 degrees with respect to the bottom plate 5 of the bucket. This solution thus enables the gravitational force affecting the material to be crushed to be utilized by making the material contained in the bucket pass more quickly via the apparatus. At the same time, the material flow is enhanced by making the crusher plate slightly straighter in shape. The throat 27 of the apparatus thus obtained, which is simpler in shape, makes a jet of material exiting the apparatus narrow and easy to control and direct at its target.

By varying the size as well as the location of installation in the drums of the crusher blades 19 provided in the present apparatuses, it is also possible to influence the crushing result. For instance, by extending the crushing blades, as shown in FIGS. 4 and 5, farther from the outer periphery of the discs 18 to which they are to be fastened, they are at the same time made to extend deeper into an interspace 30 of the discs of the adjacent drum, as well as into the comb 29 provided at an outer edge of the drum. On one hand, such a solution provides pre-screening which produces a smaller crushing product. On the other hand, this also makes reinforcement bars contained in the concrete to be crushed significantly easier to remove. Namely, a serious problem with crushing is that concrete reinforcements wind around the transfer and screening as well as crusher drums 10 and 11. By rotating backwards such above-described drums that are provided with more protruding crusher blades, the crusher blades now seize on possible reinforcement bars wound around the drums, thus unwinding the reinforcement bars wound around the drum.

Also, the usability of the apparatus may be modified by varying the position and angle of the joint arrangement 2 therein, particularly clearly seen in FIGS. 2 and 5, with respect to the bottom plate 5 of the bucket. Consequently, the inclination of the second embodiment, being about twice as abrupt and about 23 degrees, provides particularly good prerequisites for utilizing the earth's gravitational force while crushing the material. When an excavator is connected to the apparatus according to FIGS. 4 to 6, it is possible to utilize the motion of a gyratory cylinder of the excavator even more efficiently.

The apparatuses described above are used as follows.

The apparatus is installed in the excavator in the place of its ordinary bucket 1 by means of the joint arrangement 2, preferably such that the storage and crushing spaces 6*a* and 6 open away from a driver of the working machine and the discharge opening 9 thus being oriented towards the driver. This enables the apparatus to be turned into a vertical position in a simple manner and the screening and crushing operation to be easily monitored. Of course, since the joint arrangement is symmetrical, it is also possible to install the apparatus in the excavator the other way round.

When the apparatus is in use, the procedure is as follows.

The driver takes e.g. construction waste or another mineral material to be processed into the storage and crushing space 6*a* and 6 of the apparatus. At this stage, the transfer and screening as well as crusher drums 10 and 11 of the apparatus do not rotate yet. Since the apparatus is connected to a mobile carrier, the bucket may now be moved to a location wherein the crushed material is to be dumped.

When the bucket 1 resides in its location of use, the bucket is made to start to incline, in which case the mineral material, utilizing the gravitational force, becomes delivered from the storage space 6*a* towards the crushing means 8 provided in the crushing space 6. At this stage, the rotating motion of one or more drums provided in the apparatus is also started. If the apparatus is provided with more than one drum, they are located substantially in parallel and rotate in the same direction. Next, the apparatus is made to continue inclining such that the discharge opening 9 is substantially at the horizontal plane and the material contained in the crushing space 6, guided by the gravitational force and possible transfer and screening drums 10, moves to the crusher drum 11. As the material moves towards the crusher drums, at least a portion thereof meets the screen 20, in which case a material fraction having a sufficiently small diameter becomes delivered to the discharge opening 9 already at this stage. In order to enhance the separation, in addition to the comb-like projections projecting towards the transfer and screening or crusher drum, the screen may be provided with special perforation 28. The particle size of the material fraction then has a cross-sectional measure no greater than that predetermined therefor.

When the material meets, first, the transfer and screening drums 10 possibly provided in the apparatus and, subsequently, the crusher drum 11, it is also subjected to the machining and transfer motion of the crusher blades 19 provided in these drums. The crusher blades arranged between the discs 18 protruding from the axle of the rotating drum thus pre-crush the material, in which case the sufficiently small material fraction having a predetermined diameter may again be discharged, this time via interspaces formed by the drums and the discs therein.

Finally, the coarsest material fraction remaining in the crushing space 6, mainly guided by the transfer and screening drums 10, meets the crusher drum 11 which forces the particles of the material fraction to be wedged against the crusher plate 21 and become disintegrated and crushed owing to the influence of the repeatedly impacting crusher blades 19.

When the apparatus has no transfer and screening drum 10, the material immediately meets the screen 20. The screen allows a fine material fraction to pass therethrough while a coarse material fraction becomes delivered to the crusher drum 11 which subjects this material fraction to the machining and crushing motion of the crusher blades 19.

The material fraction that has been crushed to have a sufficiently small cross-section finally becomes delivered to the discharge opening 9 via the throat 27 between the crusher drum and the crusher plate. The drums of the apparatus are allowed to rotate until the exiting material flow has become considerably smaller or ended completely. The bucket may be tilted as necessary while the drums are rotating.

When the driver is content with the crushing result, the drums are stopped and new material is delivered to the crushing space of the apparatus.

The particle size to be achieved by the crusher drum 11 is adjustable by controlling the distance between the crusher plate 21 and the crusher drum. This is carried out e.g. by arranging raising parts 26 between the crusher plate and the frame of the apparatus.

It is apparent to one skilled in the art that as technology advances, the basic idea of the solution described above and in the drawing may be implemented in many different ways. The invention and its embodiments are thus not restricted to the examples described above but may vary within the scope of the claims.

The invention claimed is:

1. A method of crushing a mineral material, comprising the steps of:

delivering the mineral material to a crushing space of a bucket, the bucket forming a supporting frame and including:

side plates;

a lip plate connecting the side plates to one another;

a bottom plate extending therefrom towards a rear part of the bucket; and a cover plate located opposite the bottom plate, which define therebetween a storage space and the crushing space;

in said crushing space, subjecting the mineral material, by at least one crusher drum provided with crusher blades, to impacts decreasing its particle size, mineral particles having a size meeting a predetermined cross-sectional measure being delivered to be discharged from the crushing space;

while loading the bucket, the mineral material first filling said storage space, the storage space preceding the crushing space;

tilting the bucket such that continuing inclination thereof delivers the mineral material from the storage space towards the at least one crusher drum and at least one transfer and screening drum provided in the crushing space, utilizing gravitational force, the at least one crusher drum and at least one transfer and screening drum extending over an entire cross-section of the crushing space and being arranged on a plane which forms an angle diverging from perpendicular with respect to the bottom plate of the bucket;

separating, in the crushing space, finer particles having a predetermined size from the mineral material currently being delivered to the at least one crusher drum and at least one transfer and screening drum, whereafter rotating motion of the at least one crusher drum and at least one transfer and screening drum provided in the apparatus is started;

delivering the mineral material currently remaining in the crushing space to at least one transfer and screening drum rotated around an axle, which transfer and screening drum moves the material towards the at least one crusher drum, the transfer and screening drum pre-crushing the material, and sufficiently small material fraction having a predetermined diameter may again be discharged;

causing the mineral material to meet the at least one crusher drum which is provided in the crushing space and which is rotated around an axle, whereby the crusher drum, by its crusher blades arranged between discs protruding from the axle of the crusher drum, delivers to at least a portion of the material flow impacts decreasing the particle size of the mineral material, at the same time transferring the mineral material towards a crusher plate while mineral particles having a size meeting a predetermined cross-sectional measure are delivered to become discharged from the crushing space from between the discs; and causing the mineral material remaining in the crushing space to be subjected, by the crusher blades of the crusher drum, to impacts wedging this mineral material against the crusher plate and decreasing the particle size thereof, mineral particles achieving a size having the predetermined cross-sectional measure being delivered to be discharged from the crushing space.

2. A method as claimed in claim 1, wherein, in the crushing space, at least a portion of the material flow meets a screen via which mineral particles having a size meeting a predetermined cross-sectional measure are delivered to be immediately discharged from the crushing space.

3. A method as claimed in claim 1, wherein in the crushing space, the mineral material meets the at least one transfer and screening drum as well as the one crusher drum provided in the crushing space and rotated in the same direction around parallel axles, whereby the transfer and screening drum, by its crusher blades arranged between the discs protruding from the axle of the drum, delivers to at least a portion of the material flow impacts decreasing the particle size, at the same time transferring the mineral material towards the crusher drum while mineral particles having a size meeting a predetermined cross-sectional measure are delivered to be discharged from the crushing space from between the discs of the drums as well as from between adjacent drums.

4. A method as claimed in claim 1, wherein a position of the crusher plate with respect to the crusher drum is adjusted in order to change the particle size to be achieved in crushing.

5. A method as claimed in claim 1, wherein the axle of the crusher drum is subjected to the influence of at least one flywheel.

6. An apparatus for crushing a mineral material, the apparatus comprising:

a bucket to be installed in a working machine and constituting a supporting frame, the bucket including:

side plates;

a lip plate connecting the side plates to one another;

a bottom plate extending therefrom towards a rear part of the bucket; and a cover plate located opposite the bottom plate, which define therebetween a storage space and a crushing space;

crushing means extending over the entire cross-section of the crushing space, the crushing means separating the crushing space from a discharge opening, the crushing means in turn comprising at least one drum provided with crusher blades in order to decrease the particle size of the mineral material delivered to the crushing space, the crusher blades comprising discs protruding from an axle in the drum and crusher blades arranged therebetween, inter-spaces between the discs forming means that enable mineral particles having a size meeting a predetermined cross-sectional measure to be discharged, the crushing means further comprising a crusher plate rotationally connected to the frame of the bucket for receiving the mineral material delivered to the crusher drum and for serving as a counter surface for the crusher blades of the crusher drum;

a storage space in the bucket for receiving the mineral material to be crushed, preceding the crushing space; and means for separating and discharging a predetermined material fraction from the bucket;

wherein the crushing means are arranged on a plane which forms an angle diverging from the perpendicular with respect to a bottom plate of the bucket.

7. An apparatus as claimed in claim 6, wherein the drums provided with crusher blades comprise a crusher drum and at least one transfer and screening drum.

8. An apparatus as claimed in claim 6, wherein the bucket comprises a joint arrangement for connecting the bucket to a working machine, whereby there is a substantially 23 degree angle between the bottom plate of the bucket and said joint arrangement.

9. An apparatus as claimed in claim 6, wherein the crushing means further comprise a screen for directing mineral particles having a size meeting a predetermined cross-sectional measure to the discharge opening, the outer edge of the screen comprising projections extending to both sides of the crusher blades of the most adjacent drum in order to produce a comb-like structure.

10. An apparatus as claimed in claim 9, wherein the screen comprises perforations for directing mineral particles having a size meeting a predetermined cross-sectional measure to the discharge opening.

11. An apparatus as claimed in claim 6, wherein a position of the crusher plate with respect to the crusher drum is adjustable.

12. An apparatus as claimed in claim 6, wherein the crusher plate comprises wear pieces that are carbide-coated on a side facing the crusher drum.

13. An apparatus as claimed in claim 6, wherein the number of transfer and screening drums is at least two.

14. An apparatus as claimed in claim 6, wherein the crusher blades are arranged between discs protruding from the transfer and screening as well as crusher drum substantially equally spaced and in parallel, only one piece in each disc inter-space.

15. An apparatus as claimed in claim 14, wherein the crusher blades are arranged in the disc interspaces by utilizing a phase shift of 96 to 108 degrees in order to direct a crushing force achieved by the apparatus at only one crusher blade at a time.

16. An apparatus as claimed in claim 6, wherein the axle of the crusher drum is provided with two flywheels residing at opposite ends of the axle and fastened to the axle of the crusher drum by a friction joint.

* * * * *